US005542780A

United States Patent [19]

Kourgli

[11] Patent Number: 5,542,780

[45] Date of Patent: Aug. 6, 1996

[54] UNDERGROUND CHAMBER

[76] Inventor: Mokhtar Kourgli, 27 Stoneham Park, Petersfield, Hampshire, GU32 3BT, England

[21] Appl. No.: 179,534

[22] Filed: Jan. 10, 1994

[30] Foreign Application Priority Data

Jan. 13, 1993 [GB] United Kingdom ..... 9300530

[51] Int. Cl.[6] ..... E02D 29/12

[52] U.S. Cl. ..... 405/55; 405/53; 52/20; 52/169.6

[58] Field of Search ..... 405/53, 54, 55, 405/133, 134, 150.1, 151; 52/19, 20, 21, 169.6, 220.5, 139, 140, 141, 142; 47/33

[56] References Cited

U.S. PATENT DOCUMENTS

| | | | |
|---|---|---|---|
| 3,861,444 | 1/1975 | Portwood | 160/90 |
| 3,974,599 | 8/1976 | Grosh | 52/169.6 X |
| 4,275,757 | 6/1981 | Singer | 137/363 |
| 4,288,952 | 9/1981 | Work | 52/140 X |
| 4,621,467 | 11/1986 | Golden | 52/81 |
| 4,809,459 | 3/1989 | Brylla et al. | 47/33 |
| 4,876,124 | 10/1989 | Dallvm | 405/53 X |
| 4,920,722 | 5/1990 | Bosi | 52/20 X |
| 5,051,285 | 9/1991 | Borzakian | 428/36.4 |
| 5,060,509 | 10/1991 | Webb | 73/40.5 R |

FOREIGN PATENT DOCUMENTS

| | | |
|---|---|---|
| 0442840 | 8/1991 | European Pat. Off. . |
| 0526744 | 2/1993 | European Pat. Off. . |
| 1139956 | 1/1969 | United Kingdom . |
| 1363302 | 8/1974 | United Kingdom . |
| 1507106 | 4/1978 | United Kingdom . |
| 1529792 | 10/1978 | United Kingdom . |
| 2120698 | 12/1983 | United Kingdom . |
| 2145444 | 3/1985 | United Kingdom . |
| 2261240 | 12/1993 | United Kingdom . |

OTHER PUBLICATIONS

Access Box System, Cooper Clarke Group. PLL.

Product Selector Equipment Housing For Service Industries, Danelaw.

Dura–Line, The Problem Solved, Innovation in Underground Housing Offering a New Generation in Strength and Durability.

Aiplas Multi–Manifold Water Management System Atlantic Plastics.

Chambers for the Water Industry, Tarmac Masonry Products Limited.

Manufacturers of Thermoplastic Extrusions, Colour Coded and Printing Ducting; Poet Plastics, Ltd.

Glandel Limited, Manufacturers of Pre–Cast Concrete Products, List of Chambers.

Manufacturing Processes, Roberts and Lapidge, 1977, pp. 403–411.

*Primary Examiner*—David J. Bagnell
*Assistant Examiner*—Frederick L. Lagman
*Attorney, Agent, or Firm*—Young & Basile, P.C.

[57] ABSTRACT

A chamber for installation underground is formed of extruded or moulded plastics material. Preferably, the chamber comprises a plurality of sections (1,2,3) which are assembled in situ. The sections are preferably formed by cutting and jointing lengths of extruded or blow-moulded plastics material, and the chamber is then assembled by forming a stack of such sections.

33 Claims, 6 Drawing Sheets

FIG 6a
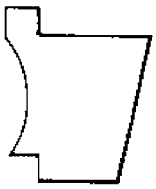
FIG 6b
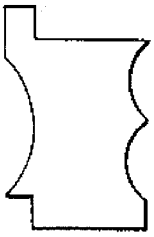
FIG 6c
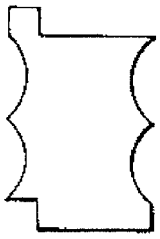
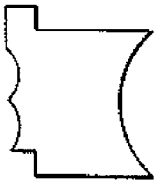
FIG 6d
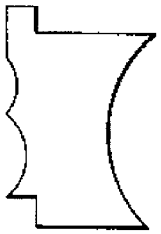
FIG 6e
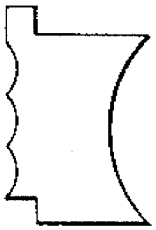
FIG 6f
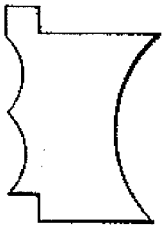
FIG 6g
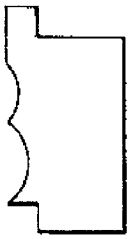
FIG 6h
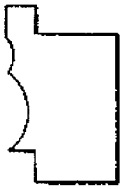
FIG 6i
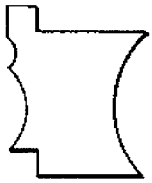
FIG 6j
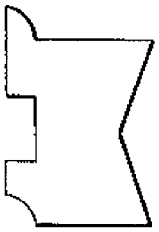
FIG 6k
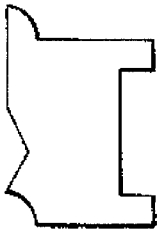
FIG 6l
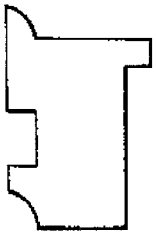
FIG 6m
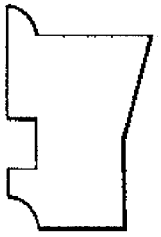
FIG 6n
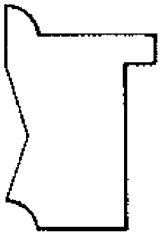
FIG 6o
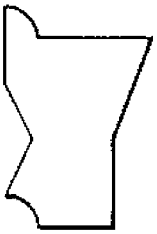
FIG 6p
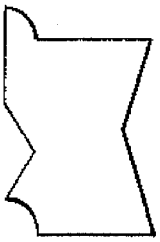
FIG 6q
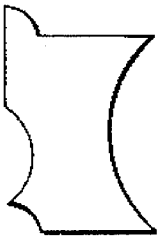
FIG 6r FIG 7a
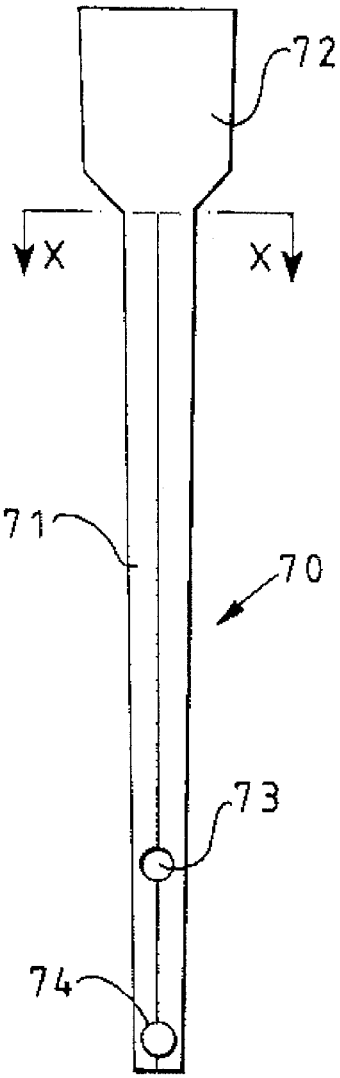
FIG 7b
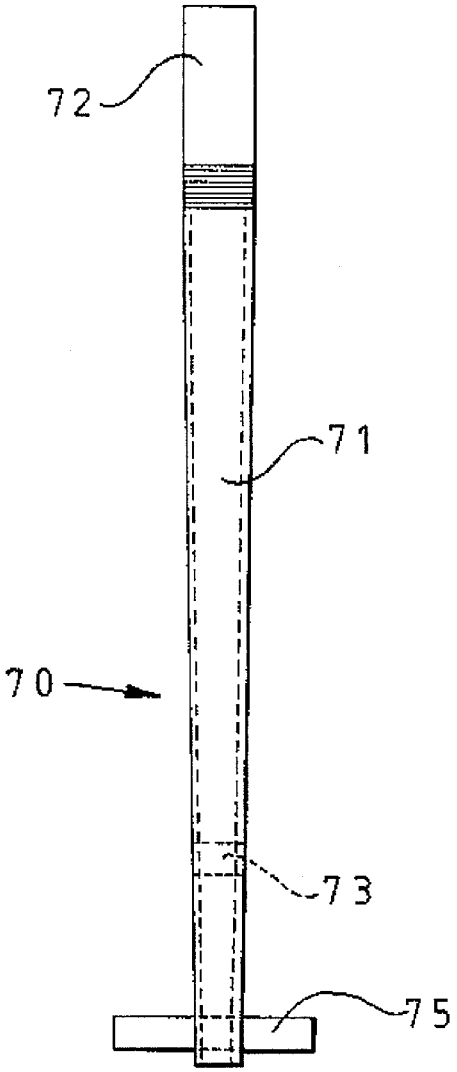
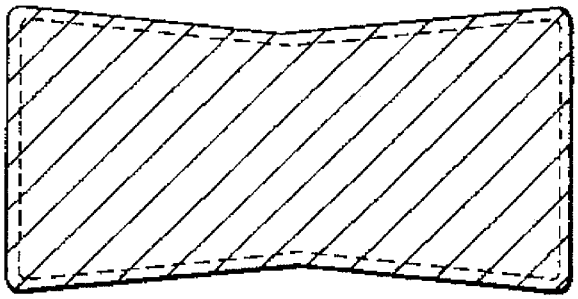
FIG 7c

UNDERGROUND CHAMBER

This invention relates to underground chambers, more particularly to underground chambers formed from interlocking sections of plastics material.

Underground chambers are widely used to house, for example, roadway utilities such as water and gas valves, electricity meters and junction boxes, hydrants and stopcocks. The construction of such chambers has previously been carried out using engineering bricks, which is clearly time-consuming, labour-intensive and expensive. More recently, preformed concrete sections have been used. These sections are formed such that stacked sections interlock to form a chamber, the base and roof of the chamber being formed of special sections. Such concrete sections are heavy and have rough edges. This makes them difficult to handle, with the danger of back or hand injury to the user. In addition, they are relatively brittle and are frequently broken during installation, in which case the broken sections must be discarded.

There has now been devised an improved form of chamber for underground use, which overcomes or substantially mitigates these disadvantages.

According to the invention, there is provided a chamber for installation underground, the chamber being formed of extruded or moulded plastics material.

The chamber according to the invention is advantageous primarily in that it is light in weight and has no sharp edges, which makes it easy to handle and install. Surprisingly, however, the chamber has been found to possess excellent mechanical properties with good compressive and tensile strengths. The chamber is robust and is not susceptible to breakage during construction or use. The chamber is chemically resistant and impervious to frost. Also, the chamber is capable of withstanding both static and dynamic loading, and is therefore suitable for installation under roads and the like.

By 'installation underground' is meant any situation in which the base of the chamber and at least a portion of its sides are installed below ground level. Commonly, the installation may be such that the roof of the chamber is flush, or substantially flush, with the ground level.

The chamber according to the invention may be preformed as a complete or substantially complete unit. Alternatively, and preferably, the chamber may comprise a plurality of sections which are assembled in situ to form the chamber. Such sections are preferably arranged in a stack. The sections in the stack may have any suitable shape, eg square, rectangular or circular.

Thus, according to a particularly preferred aspect of the invention, there is provided a chamber for installation underground comprising a stack of interlocking sections formed of extruded or moulded plastics material.

The chamber conveniently comprises a base section, one or more wall sections which define the sides of the chamber, and a top section which preferably includes an opening by means of which access can be gained to the chamber.

Suitable plastics materials which may be used include polyolefins, though other plastics, eg polyvinylchloride containing 8–10% acrylic, may also be used. Suitable polyolefins include polyethylene and polypropylene. The polyolefin is preferably a mixture of polyethylene and polypropylene, each of which is preferably present in proportions of 30 to 70% by weight. Typically, the product may include approximately equal amounts, say 30 to 50% by weight, of low-density polyethylene and polypropylene, and may also include high-density polyethylene, eg in an amount of 10 to 30% by weight. The plastics used may be recycled plastics.

In addition, eg to reduce cost, fillers such as wood flour or fibres or recycled aluminium powder may be incorporated.

Compression moulded components, eg for use as base sections, may comprise mixtures of low-density polyethylene and fly-ash, typically in proportions of 50–60% by weight of polyethylene.

Typically, the material used may have the following properties:

| | |
|---|---|
| Density @ 20° C. | 670–770 kg/m$^3$ |
| Bending moment @ 20° C. | 20–26 N/mm$^2$ |
| Compressive strength | 24–29 N/mm$^2$ |
| Elasticity modulus | 2400–2500 |

The material may be extruded or blow-moulded in lengths of, typically, 2 to 6 m. Another forming technique which may be used is so-called intrusion moulding, in which an extrusion machine is used to fill molten polymer into a mould.

For ease of fabrication, sections used to form the sides of the underground chamber are preferably square or rectangular and may be formed by cutting and jointing suitable lengths of the extruded or moulded material. The joints between the components of each section may have various forms including butt joints, mitred joints and interlocking joints such as comb and dovetail joints. Mitred joints offer the preferred combination of simplicity and strength.

The joints are preferably secured by suitable fastening means. Such means include fasteners fired pneumatically or otherwise, nails or gang nails (particularly for comb or dovetail joints), welding (eg butt fusion or friction fusion), and ultrasonic stapling. Combinations of such techniques may be used, if appropriate.

The sections forming the chamber preferably interlock so as to confer a degree of rigidity on the assembled structure. For this purpose, abutting surfaces of adjacent sections are most preferably formed with complementary formations, such as projections and recessess or suitably formed rebates.

The chamber according to the invention may be used to house utilities for many applications. Examples are utilities installed by:

Water companies - eg hydrants, valves, manifolds, domestic and commercial metering;

Gas companies - eg governor pits, pressure test pits, zone valve pits;

Railway companies - eg draw pits, signals and telecommunications chambers;

Local authorities - eg street lighting or traffic management utilities, sewer inspection pits, gulley raising pieces, surface water collection gullies;

Telecommunication companies - eg junction pits, inspection chambers.

The chamber according to the invention may incorporate, or be used in association with, ancillary components such as marker or demarcations posts. These may be formed of similar material to the rest of the chamber.

The invention will now be described in greater detail, by way of illustration only, with reference to the accompanying drawings, in which FIG. 1 is a sectional view of a sectionned underground chamber according to the invention; FIG. 2 shows a wall section forming part of the chamber of FIG. 1, in (a) perspective view from above, (b) perspective view from below, (c) plan view from above, (d) sectional view along the line Y—Y in (c), (e) sectional view along the line X—X in (c);

FIG. 5 shows a pair of complementary sections which together define an inlet and outlet for a pipe, in particular showing (a) perspective view of the first section from above, (b) perspective view of the second section from above, (c) plan view of the section of (b), (d) sectional view along the line X—X in (c), (e) end elevational view of the pair of sections; FIG. 6 shows sectional views of various forms of extrusion used to construct sections similar to those shown in FIG. 2; and FIG. 7 shows a demarcation post for use in association with an underground chamber according to the invention, in (a) front elevation, (b) side elevation, (c) sectional view along the line X—X in (a).

Figure 1:
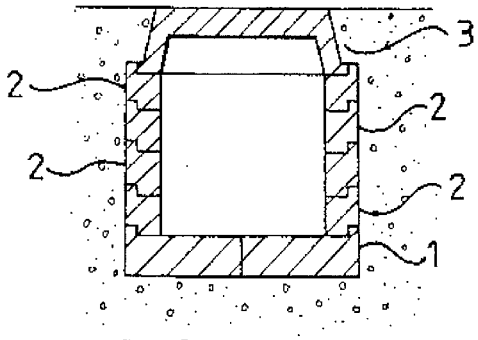
Figure 2A:
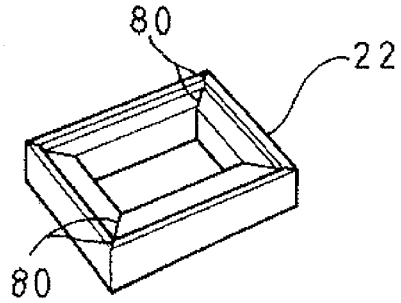
Figure 2B:
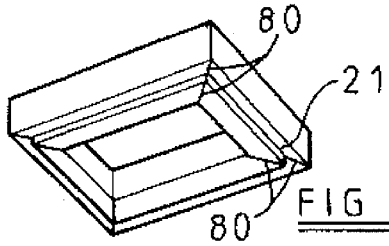
Figure 2C:
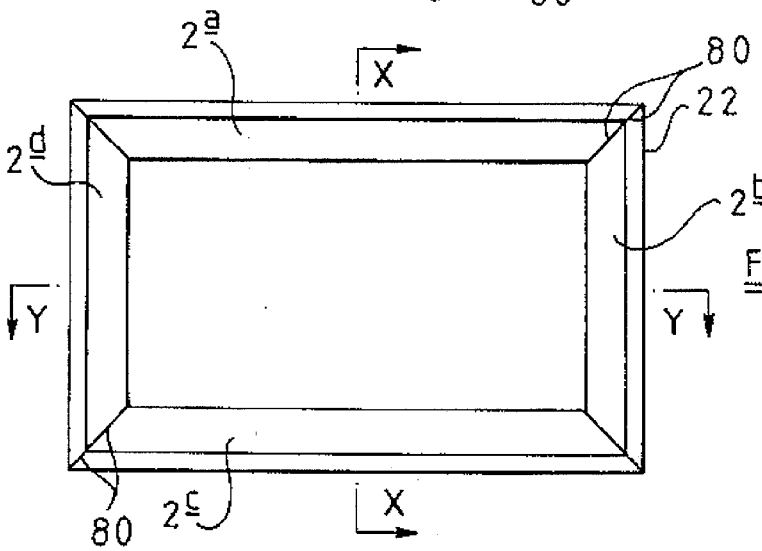
Figure 2D:
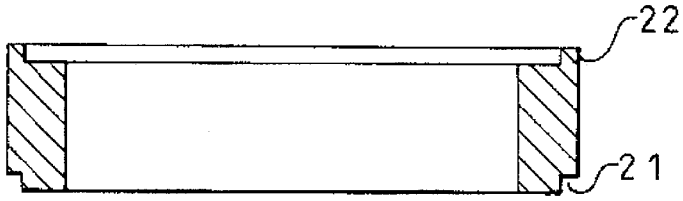
Figure 2E:
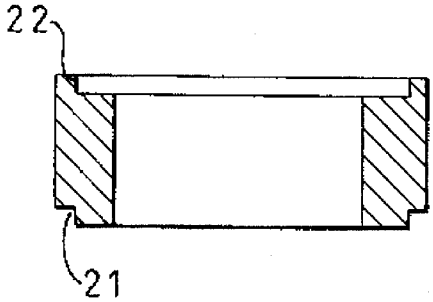
Figure 3A:
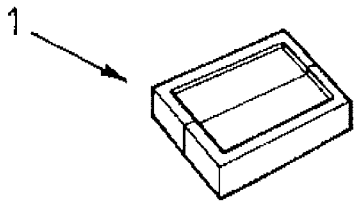
FIG. 3 shows a base section forming part of the chamber of FIG. 1, in (a) perspective view from above, (b) plan view from above, (c) sectional view along the line Y—Y in (b), (d) sectional view along the line X—X in (b)
Figure 3B:
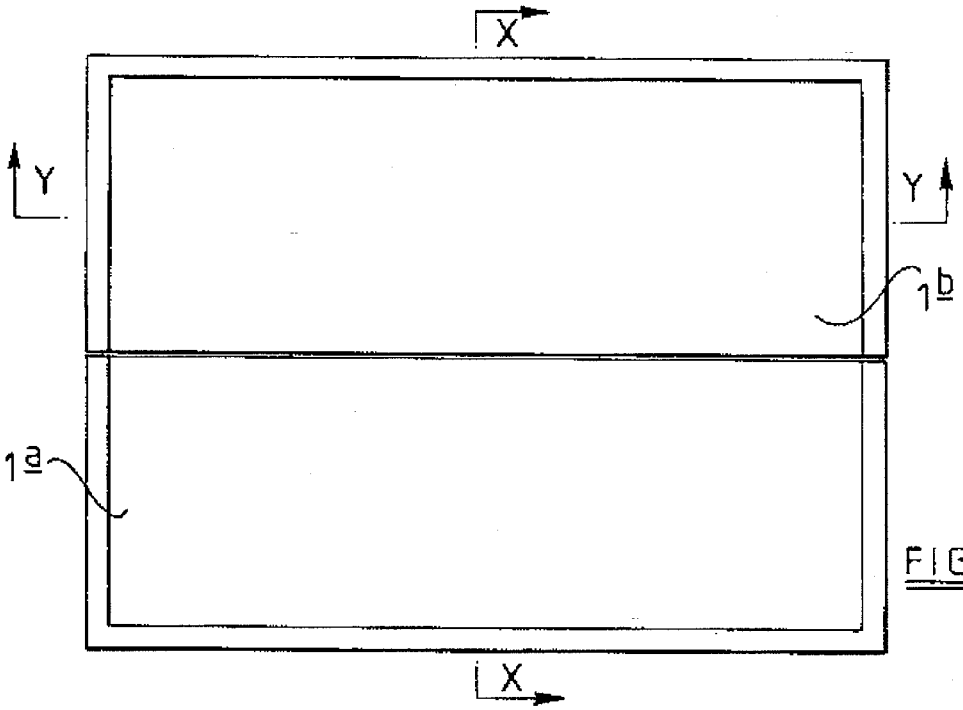
Figure 3C:
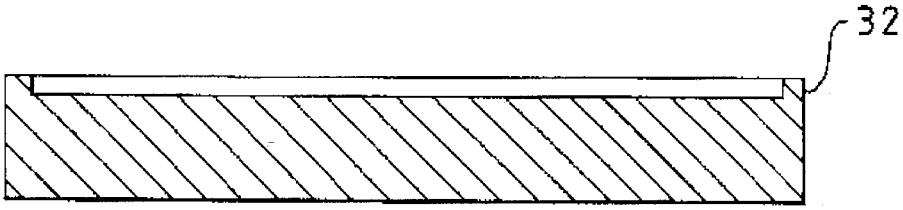
Figure 3D:
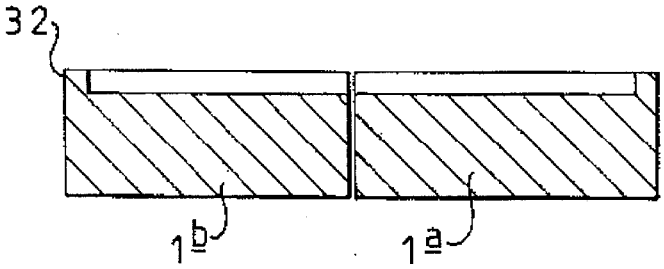
Figure 4A:
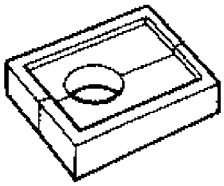
FIG. 4 shows a second form of base section, in (a) perspective view from above, (b) plan view from above, (c) sectional view along the line Y—Y in (b), (d) sectional view along the line X—X in (b)
Figure 4B:
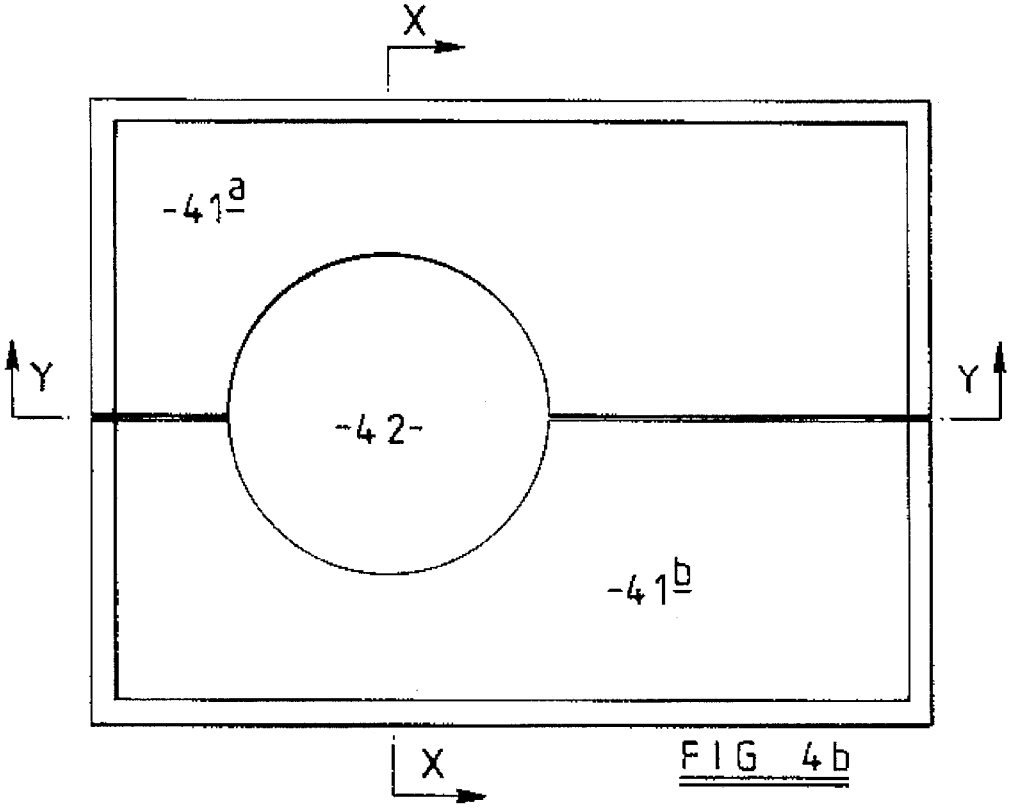
Figure 4C:
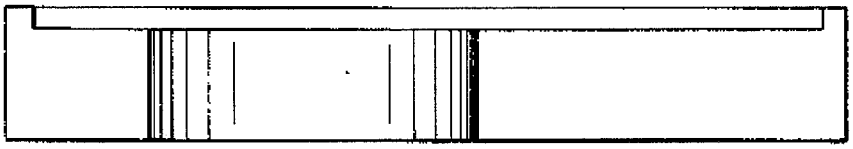
Figure 4D:
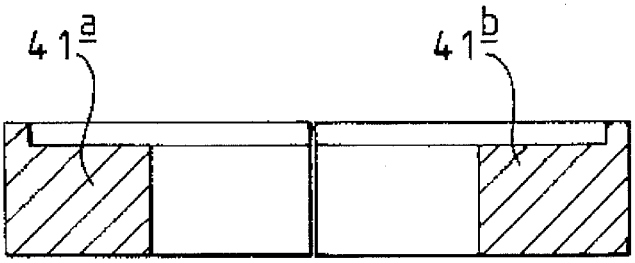
Figure 5A:
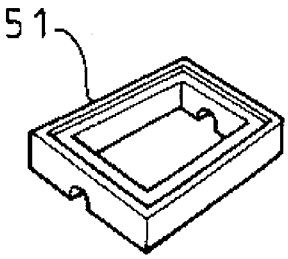
Figure 5B:
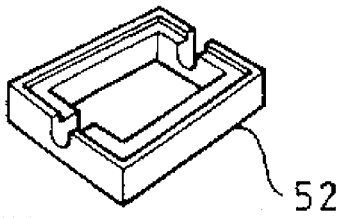
Figure 5C:
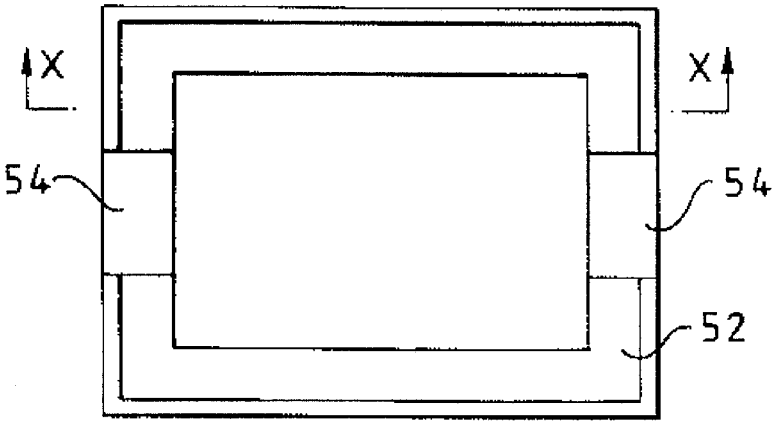
Figure 5D:
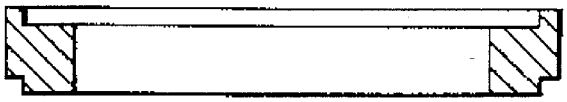
Figure 5E:
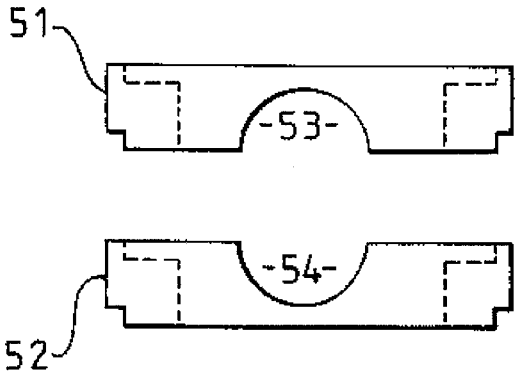

Referring first to FIG. 1, an underground chamber for housing a utility such as an elecricity meter comprises a base section 1, a stack of four identical wall sections 2 and a cover section 3. The chamber is constructed at such a depth that the upper surface of the cover section 3 is flush with the surrounding ground (which is typically a road or pavement surface). The cover section 3 supports an inspection cover (not shown) by means of which access can be gained to the chamber.

The wall section 2 comprises extruded plastics material having the following composition:

| | |
|---|---|
| Low density polyethylene | 40% w/w |
| Polypropylene | 40% w/w |
| High density polyethylene | 18% w/w |
| Masterbatch (pigmentation) | 2% w/w |

The wall section 2 is shown in greater detail in FIG. 2. Referring first to FIG. 2(*c*), it can be seen that the section 2 comprises four mitred lengths 2*a–d* of the plastics extrusion, jointed together to form a rectangle. The mitred lengths 2*a–d* may be jointed by any of the techniques described above, including by means of mitered joints 80.

As can be seen most clearly from FIGS. 2(*d*) and (*e*), the plastics extrusion is formed in such a way that the lower surface of the section 2 is provided with a rebate 21, and the upper surface with a peripheral lip 22. In use, when sections 2 are stacked to form the chamber, the lip 22 on one section 2 locates in the rebate 21 on the underside of the adjacent section.

Turning now to FIG. 3, the base section 1 is formed of two identical halves 1*a*, 1*b* which are blow-moulded from the same material as the wall sections 2. Again a peripheral lip 32 extends around the upper edge of the base section 1. The lip 32 locates in the rebate 21 of the lowest of the wall sections 2.

In use, an underground chamber is constructed in situ by placing a base section 1 at an appropriate depth below ground level. If desired, the base section 1 can be laid on a prepared foundation of, for example, hard core or concrete. An appropriate number of wall sections 2 (eg four such sections as shown in FIG. 1) are then stacked on the base section 1. The chamber is completed by location of a cover section 3 on the stack of wall sections 2. The space around the chamber is then back-filled and the surface levelled and finished.

FIG. 4 shows a second embodiment of base section, similar to that of FIG. 3, save that the two half-sections 41*a*, 41*b* have semi-circular cut-outs which together define a circular opening 42. Such a base section is used to house, for example, a valve or hydrant extending upwardly from an underground pipe.

The wall sections shown in FIG. 5 are used to construct chambers in which pipes enter above the base of the chamber. The end walls of the upper and lower sections 51,52 are provided with complementary semi-circular cut-outs 53,54 which together define circular openings in opposite ends of the assembled chamber.

FIG. 6 shows various forms of extrusion profile which may be used to produce sections similar to those shown in FIG. 2. The profiles differ from that shown in FIG. 2 principally in that the internal and external faces are concave or sloping. This has the advantage of reducing the material content of the extrusion, saving on cost and weight. In addition, the concavities in the external surfaces of the sections can provide better anchorage of the chamber.

Finally, FIG. 7 shows several views of a demarcation post 70 for use with a chamber according to the invention. The post 70 is moulded from the same material as is used for the chamber sections, and comprises a stem 71 with an enlarged head 72. The lower portion of the stem 71 is provided with two bores 73,74 which can receive a dowel 75. The dowel 75 is shown in the lower bore 74. If the bore were inserted instead in the upper bore 73, the post 70 would project a lesser distance above the chamber.

I claim:

1. A method of forming a chamber for underground installation, comprising the steps of:

forming extruded or blow-molded lengths of plastic material;

cutting and forming joints between said lengths to form square or rectangular chamber sections; and forming a stack of said sections;

wherein the chamber thereby formed exhibits high compressive and tensile strengths, and further is capable of withstanding both static and dynamic loading.

2. The method as claimed in claim 1, wherein said joints are mitered joints.

3. The method as defined in claim 1, further comprising the step of positioning a base section underground, said stack of said chamber sections being formed on top of said base section.

4. The method as defined in claim 3, wherein said base section is compression molded from a mixture of low density polyethylene and fly ash.

5. The method as defined in claim 1 wherein the chamber has an interior, the method further comprising the step of placing a top section on top of said stack of said chamber sections, said top section including an opening which provides access to the interior of said chamber.

6. The method as defined in claim 1 wherein said chamber sections interlock.

7. The method as defined in claim 1 wherein abutting surfaces of adjacent chamber sections are formed with complementary, mating projections and recesses such that adjacent sections interlock.

8. The method as defined in claim 1 wherein two adjacent chamber sections together define an opening adapted to receive an item of equipment extending into said chamber.

9. The method as defined in claim 1 wherein at least one of internal and external faces of said chamber sections are one of concave and sloping.

10. The method as defined in claim 1 wherein said plastic material is a polyolefin.

11. The method as defined in claim 10 wherein said polyolefin is selected from the group consisting of polyethylene, polypropylene and mixtures thereof.

12. The method as defined in claim 10 wherein said polyolefin is a mixture of about 30% to about 70% by weight polyethylene and about 30% to about 70% by weight polypropylene.

13. The method as defined in claim 10 wherein said polyolefin comprises about 30% to about 50% by weight low density polyethylene and about 30% to about 50% by weight polypropylene.

14. The method as defined in claim 10 wherein said polyolefin comprises high density polyethylene in an amount between about 10% and about 30% by weight.

15. The method as defined in claim 1 wherein said plastic material comprises recycled plastic material.

16. The method as defined in claim 1 wherein said plastic material incorporates a filler material.

17. The method as defined in claim 16 wherein said filler material is selected from the group consisting of wood flour, wood fibers and recycled aluminum powder.

18. A chamber for installation underground, said chamber comprising a stack of square or rectangular chamber sections, said chamber sections being formed by cutting and jointing extruded or blow-molded lengths of plastic material, wherein the chamber thereby formed exhibits high compressive and tensile strengths, and further is capable of withstanding both static and dynamic loading.

19. The chamber as defined in claim 18 wherein said jointing is the formation of mitered joints.

20. The chamber as defined in claim 18 wherein said chamber has an interior, and wherein said chamber further comprises a top section including an opening which provides access to the interior of said chamber.

21. The chamber as defined in claim 18 wherein said chamber further comprises a base section compression molded from a mixture of low density polyethylene and fly ash.

22. The chamber as defined in claim 18 wherein said chamber sections interlock.

23. The chamber as defined in claim 18 wherein abutting surfaces of adjacent chamber sections are formed with complementary, mating projections and recesses such that said adjacent chamber sections interlock.

24. The chamber as defined in claim 18 wherein two adjacent chamber sections together define an opening adapted to receive an item of equipment extending into said chamber.

25. The chamber as defined in claim 18 wherein at least one of internal and external faces of said chamber sections are one of concave and sloping.

26. The chamber as defined in claim 18 wherein said plastic material is a polyolefin.

27. The chamber as defined in claim 26 wherein said polyolefin is selected from the group consisting of polyethylene, polypropylene and mixtures thereof.

28. The chamber as defined in claim 26 wherein said polyolefin is a mixture of about 30% to about 70% by weight polyethylene and about 30% to about 70% by weight polypropylene.

29. The chamber as defined in claim 26 wherein said polyolefin comprises about 30% to about 50% by weight low density polyethylene and about 30% to about 50% by weight polypropylene.

30. The chamber as defined in claim 26 wherein said polyolefin comprises high density polyethylene in an amount between about 10% and about 30% by weight.

31. The chamber as defined in claim 18 wherein said plastic material comprises recycled plastic material.

32. The chamber as defined in claim 18 wherein said plastic material incorporates a filler material.

33. The chamber as defined in claim 32 wherein said filler material is selected from the group consisting of wood flour, wood fibers and recycled aluminum powder.

* * * * *